United States Patent [19]

Sung et al.

[11] Patent Number: 4,482,354

[45] **Date of Patent: * Nov. 13, 1984**

[54] MIDDLE DISTILLATE HYDROCARBON COMPOSITIONS CONTAINING THERMAL STABILITY ADDITIVE

[75] Inventors: Rodney L. Sung, Fishkill; William M. Sweeney, Wappingers Falls, both of N.Y.; Wheeler C. Crawford, Houston, Tex.

[73] Assignee: Texaco Inc., White Plains, N.Y.

[ * ] Notice: The portion of the term of this patent subsequent to Oct. 11, 2000 has been disclaimed.

[21] Appl. No.: 535,129

[22] Filed: Sep. 23, 1983

[51] Int. Cl.[3] ..... C10L 1/08

[52] U.S. Cl. ..... 44/57; 44/71; 585/13

[58] Field of Search ..... 44/57, 71; 208/15; 385/13

[56] References Cited

U.S. PATENT DOCUMENTS

| | | | |
|---|---|---|---|
| 4,132,531 | 1/1979 | Cummings et al. | 44/71 |
| 4,290,778 | 9/1981 | Herbstman et al. | 44/71 |
| 4,321,062 | 3/1982 | Herbstman et al. | 44/71 |

*Primary Examiner*—Mrs. Y. Harris-Smith

*Attorney, Agent, or Firm*—Robert A. Kulason; Carl G. Seutter

[57] ABSTRACT

Middle distillate hydrocarbons extended with a shale oil-derived diesel oil fraction, containing (alkyl polyoxyalkyl) amino alkanoic acid are characterized by improved thermal stability.

12 Claims, No Drawings

MIDDLE DISTILLATE HYDROCARBON COMPOSITIONS CONTAINING THERMAL STABILITY ADDITIVE

FIELD OF THE INVENTION

This invention relates to a middle distillate hydrocarbon composition particularly characterized by thermal stability. More particularly it relates to a novel extended middle distillate such as a jet fuel composition.

BACKGROUND OF THE INVENTION

As is well known to those skilled in the art, middle distillate fuels such as aviation jet fuels form gums and deposits on storage, particularly when storage is at elevated temperature. These gums and deposits are undesirable in that they may interfere with operation by partially or wholly clogging narrow passageways through which the fuel is to pass. The standard test method for determining the amount of thermal degradation products of middle distillate hydrocarbon fuels such as Jet Fuels is ASTM, Jet Fuel Thermal Oxidation Test D-3241. In this JFTOT test, a fuel is maintained at elevated temperature; and the amount of gum and deposit is determined. The results are measured in terms of the amount of deposit on an aluminum heater tube and the rate of plugging of a 17 μm nominal porosity precision filter; and a visual rating of 0–2 is good and 3–4 is unsatisfactory by comparison with a standard. Preliminary screening testing may be carried out using a test temperature of 400° F. (in a Modified JFTOT Test) rather than the standard temperature of 500° F.

It is an object of this invention to improve the thermal stability of a middle distillate. Other objects will be apparent to those skilled in the art.

STATEMENT OF THE INVENTION

In accordance with certain of its aspects, this invention is directed to a middle distillate composition comprising (a) a major portion of middle distillate fuel containing a hydrocarbon boiling in the middle distillate boiling range;

(b) an extending portion of a shale oil diesel fraction; and (c) a minor effective amount of, as thermal stability additive, an (alkyl polyoxyalkyl) amino alkanoic acid.

DESCRIPTION OF THE INVENTION

The fuels which may be used in practice of the process of this invention include middle distillate fuels which boil above gasolines and below heavier lube oil fractions. Middle distillate fuels contain hydrocarbons which boil in the middle distillate boiling range. Typically these fuels have an ibp of 270° F.–400° F., typically 340° F.–400° F., sy about 350° F.; a 50% bp of 400° F.–670° F., typically 420° F.–520° F., say about 425° F.; and an ep of 500° F.–660° F., typically 525° F.–640° F., say about 525° F.

Typical middle distillates may include kerosene, diesel fuel, light cycle gas oil, intermediate light cycle gas oil, etc.

A typical gas oil may be characterized by an ibp of 358° F., a 50% bp of 500° F., an ep of 580° F., and an API Gravity of 40.5.

A typical light cycle gas oil may be characterized by an ibp of 356° F., a 50% bp of 500° F., an ep of 640° F., and an API Gravity of 32.8.

A typical diesel oil may be characterized by an ibp of 357° F., a 50% bp of 418° F., an ep of 550° F., an API Gravity 45.1, and a Cetane No. of 50.

A typical intermediate light cycle gas oil may be characterized by an ibp of 270° F., a 50% bp of 664° F., an ep of 690° F., and an API Gravity of 21.2.

The advantages of this invention may be particularly advantageous when it is carried out in connection with a middle distillate hydrocarbon, such as jet fuel, which has been extended with a shale oil diesel fraction.

The base jet fuel in which the additive of the invention may be used to form a jet fuel composition may comprise a mixture of hydrocarbons boiling in the jet fuel boiling range. This base fuel may contain straight chain or branched chain paraffins, cycloparaffins, olefins, and aromatic hydrocarbons and any mixture of these. The base fuel may be derived from straight-chain naphtha, polymer gasoline, natural gasoline, catalytically cracked or thermally cracked hydrocarbons, catalytically reformed stocks, etc.

The jet fuels which may be used in practice of this invention may be characterized by the fact that they contain hydrocarbons which boil in the jet fuel boiling range which is characterized by an ibp of 320° F.–360° F., say about 350° F., a 50% bp of 400° F.–430° F., say bout 425° F.; and an ep of 500° F.–530° F., say about 525° F.

A typical jet fuel may be Avjet A characterized as follows:

TABLE

| | Jet Fuel A |
|---|---|
| Gravity, ° API | 42.4 |
| ASTM Distillation °F. | |
| ibp | 350 |
| 10% | 376 |
| 30% | 400 |
| 50% | 423 |
| 90% | 486 |
| 95% | 504 |
| EP | 526 |
| Flash Point °F. | 126 |
| Cloud Point, °F. | −56 |
| Pour Point, °F. | −55 |
| Cetane | 43.0 |
| Kin Vis cs @ 40° C. | 1.5 |
| % S, X-ray | 0.04 |
| JFTOT @ 400° F.* | 2 |

*Modified Jet Fuel Thermal Oxidation Test, ASTM D-3241

It is a feature of this invention that it is possible to extend middle distillates such as jet fuels by the addition thereto of a shale oil diesel fraction prepared by distillation of shale oil. A shale oil diesel fraction may typically have the following properties:

TABLE

| | Paraho Derived Diesel Fuel (From Shale Oil) | |
|---|---|---|
| | Broad | Typical |
| Gravity, ° API | 30–40 | 32.6 |
| ASTM Distillation °F. | | |
| ibp | 500–520 | 510 |
| 10% | 525–535 | 530 |
| 30% | 560–570 | 568 |
| 50% | 590–600 | 593 |
| 90% | 650–660 | 659 |
| 95% | 670–680 | 676 |
| EP | 670–680 | 678 |
| Flash Point °F. | 180–190 | 184 |

TABLE-continued

| | Broad | Paraho Derived Diesel Fuel (From Shale Oil) Typical |
|---|---|---|
| Cloud Point, °F. | | Unsuitable |
| Pour Point, °F. | 45–55 | 50 |
| Cetane | 60–65 | 62.8 |
| Kin Vis cs @ 40° C. | 5.0–5.5 | 5.30 |
| % S, X-ray | 0.50–0.60 | 0.58 |
| JFTOT @ 400° F.* | 3–4 | 4 |

*Modified Jet Fuel Thermal Oxidation Test, ASTM D-3241

Middle distillate hydrocarbons such as jet fuel may be blended with shale oil diesel fraction to form an extended Jet fuel containing 80–95 v%, say 90 v% of Jet fuel. It is found that the thermal stability of such extended jet fuels may be unsatisfactory. For example in a typical instance a jet fuel having a JFTOT rating of 2 may be blended with a shale oil diesel fraction having a rating of 4 (90:10 by volume) to give a product having a rating of 4+ which is unsatisfactory.

An extending portion of the shale oil diesel fraction is typically 5–15 parts, say 10 parts by volume of the shale oil diesel fraction per 100 parts by volume of jet fuel. In a typical mixture, this corresponds to about 80–95 v%, say 90 v% of jet fuel and 5–20 v%, say about 10 v% of shale oil diesel fraction.

The compositions of this invention may contain any of the additives normally employed in middle distillates.

In accordance with practice of this invention, there may be added to a major portion of the extended middle distillate, typically a jet fuel, a minor effective amount of, as a thermal stability additive, an (alkyl polyoxyalkyl) amino alkanoic acid.

Preferably the additive has the formula $$R(OR')_aNR''COOH$$

In the above formula,

R may be an alkyl group typified by methyl, ethyl, propyl, isopropyl, n-butyl, isobutyl, amyls, hexyls, octyls, etc. R may contain 1–20 carbon atoms, preferably 10–15, more preferably 10–12 carbon atoms.

R' and R'' may each be a divalent alkylene group containing 1–8 carbon atoms, typically 1–4, say 2–3 carbon atoms. Preferably R'' is $—C_2H_4—$ and R' is $$-CH_2\underset{\underset{CH_3}{|}}{CH}-$$

a maybe 1–20, preferably 1–5, say 1–2.

Illustrative compositions may be the following, the first noted being preferred:

TABLE

A $CH_3(CH_2)_{8-10}CH_2(OCH_2\underset{\underset{CH_3}{|}}{CH})_2NHCH_2CH_2COOH$ B $CH_3(CH_2)_{8-10}CH_2(OCH_2\underset{\underset{CH_3}{|}}{CH})_3-NH-CH_2CH_2-COOH$ C $CH_3(CH_2)_{8-10}CH_2(OCH_2\underset{\underset{CH_3}{|}}{CH})_2-NH-CH_2\overset{\overset{CH_3}{|}}{CH}-COOH$ TABLE-continued D $CH_3(CH_2)_{8-10}CH_2(OCH_2\underset{\underset{CH_3}{|}}{CH})_3NH-CH_2\overset{\overset{CH_3}{|}}{CH}-COOH$ E $CH_3(CH_2)_{8-10}CH_2(OCH_2\underset{\underset{CH_3}{|}}{CH})_4NH-CH_2-\underset{\underset{CH_3}{|}}{CH}-COOH$ These composition may be commercially available under Jeffamine trademarks typified by Jeffamine Experimental surfactant MA-300. One preferred commercially available product is the first noted in the above table, available under the trademark Jeffamine Surfactant MA-300.

It is possible to readily prepared these compositions. For example, the preferred composition may be prepared by the reaction of equimolar portions of acrylic acid with the Jeffamine M-300 brand of $$R(OCH_2\underset{\underset{CH_3}{|}}{CH})_xOCH_2\underset{\underset{CH_3}{|}}{CH}NH_2$$

wherein R is a mixture of linear C-10 and C-12 alkyl groups and x has the average value of 2.

$$R(OCH_2\underset{\underset{CH_3}{|}}{CH})_xOCH_2\underset{\underset{CH_3}{|}}{CH}-NH_2 + CH_2{=}CHCOOH \longrightarrow R(OCH_2\underset{\underset{CH_3}{|}}{CH})_xOCH_2\underset{\underset{CH_3}{|}}{CH}-NHCH_2CH_2COOH$$

In practice of this invention according to certain of its aspects, the additive may be added to the base fuel in minor effective amount. The additives are particularly effective in amount of 0.01–1 w% (ca 26–2600 PTB), preferably 0.1–0.3 w% (ca 260–785 PTB), of the total fuel composition. Preferred range may be 0.1–0.3 w%, (ca 260–785 PTB) more preferably 0.15–0.25 w%, (ca 390–650 PTB), say 0.2 w% (ca 520 PTB). PTB stands for pounds per thousand barrels.

It is a feature of this invention that the fuel composition as prepared is characterized by improved ratings on the Modified JFTOT Test ASTM D-3241.

DESCRIPTION OF PREFERRED EMBODIMENTS

Practice of this invention will be apparent to those skilled in the art from the following examples wherein, as elsewhere in this specification, all parts are parts by weight unless otherwise specified.

EXAMPLE I

In this example which illustrates the best mode known to me of practicing the process of this invention, the reference fuel is the Jet Fuel A hereinbefore tabulated. There is added to this Jet Fuel A, a shale oil diesel fraction, identified as a Paraho Derived Diesel Fuel, having the specific properties set forth as typical in the table supra. The final composition contained 90 v% Jet Fuel A and 10 v% of Paraho Derived Diesel Fuel. The additive is 0.2 w% of the Jeffamine MA-300 brand of Component A of the Table:

$$CH_3(CH_2)_{8-10}CH_2(OCH_2\underset{\underset{CH_3}{|}}{C}H)_2NHCH_2CH_2COOH$$

EXAMPLE II*

In this control example, the Modified JFTOT test was carried out on the charge Jet Fuel alone.

EXAMPLE III*

In this control example, the Modified JFTOT test was carried out on the Paraho Derived Diesel Fuel alone.

EXAMPLE IV*

In this control example, the Modified JFTOT test was carried out on the 90:10 v mixture of Jet Fuel and Paraho Derived Diesel Fuel alone.

The results are as follows:

TABLE

| Example | Modified JFTOT Rating | Composition |
|---|---|---|
| I | 1 | Jet Fuel (90 v %)<br>Shale oil Diesel Oil Fraction (10 v %)<br>Additive (0.2 w %) |
| II* | 2 | Jet Fuel |
| III* | 4 | Shale oil Diesel Oil Fraction |
| IV* | 4+ | Jet Fuel (90 v %)<br>Shale oil Diesel Oil Fraction (10 v %) |

From the above table, it is apparent that the presence of the additive permits attainment of outstanding results. For example, as may be seen by comparing Example I with Example IV*, it is possible to upgrade an extended jet fuel having an undesirable Modified JFTOT rating of 4+; by addition of 0.2 w% additive the rating is upgraded to 1.

The novel products of this invention are characterized by improved (i.e. decreased) formation of gums and deposits after standing at elevated temperatures.

Results comparable to those of Example I may be obtained if the additive is

TABLE

| EXAMPLE | ADDITIVE |
|---|---|
| V | $C_{10}H_{21}(OCH_2\underset{\underset{CH_3}{\vert}}{C}H)_2NHCH_2COOH$ |
| VI | $C_{11}H_{23}(OCH_2\underset{\underset{CH_3}{\vert}}{C}H)_2NHCH_2CH_2COOH$ |
| VII | $C_{12}H_{25}(OCH_2\underset{\underset{CH_3}{\vert}}{C}H)_2NHCH_2CH_2COOH$ |
| VIII | $C_{10}H_{21}(OCH_2\underset{\underset{CH_3}{\vert}}{C}H)_3NHCH_2CH_2COOH$ |

Results comparable to those of Example I may be obtained if the middle distillate is:

TABLE

| Example | Middle Distillate | |
|---|---|---|
| IX | Gas Oil | 40.5 API |
| | ibp | 358° F. |
| | 50% bp | 500° F. |

TABLE-continued

| Example | Middle Distillate | |
|---|---|---|
| | ep | 580° F. |
| | Pour Point (D-19) | +10° F. |
| | Cetain No. (D-613) | 55.2 |
| X | Light Cycle Gas Oil | 32.8 API |
| | ibp | 356° F. |
| | 50% bp | 500° F. |
| | ep | 640° F. |
| | Pour Point (D-19) | +25° F. |
| | Cetain No. (D-613) | 42.2 |
| XI | Diesel Oil | 45.1 API |
| | ibp | 357° F. |
| | 50% bp | 418° F. |
| | ep | 550° F. |
| | Pour Point (D-19) | −25° F. |
| | Cetane No. (D-613) | 50 |
| XII | Intermediate Light Cycle Gas Oil | 21.2 API |
| | ibp | 270° F. |
| | 50% bp | 664° F. |
| | ep | 690° F. |
| | Pour Point (D-19) | 74° F. |
| | Cetane No. (D-613) | 39.7 |

Although this invention has been illustrated by reference to specific embodiments, it will be apparent to those skilled in the art that various changes and modifications may be made which clearly fall within the scope of this invention.

We claim:

1. A middle distillate composition comprising
(a) a major portion of a petroleum derived middle distillate containing a hydrocarbon boiling in the middle distillate boiling range;
(b) an extending portion of a shale oil diesel fraction; and
(c) a minor effective amount of, as thermal stability additive, an (alkyl polyoxyalkyl) amino alkanoic acid.

2. A middle distillate composition as claimed in claim 1 wherein said effective amount is about 0.01–1.0 w% of the fuel.

3. A middle distillate composition as claimed in claim 1 wherein said effective amount is about 0.05–0.5 w% of the fuel.

4. A middle distillate composition as claimed in claim 1 wherein said effective amount is about 0.1–0.3 w% of the fuel.

5. A middle distillate composition as claimed in claim 1 wherein said additive has the formula $$R(OR')_aNR''COOH$$

wherein R is an alkyl hydrocarbon group, R' and R'' are divalent alkylene hydrocarbon groups, and a is 1–20.

6. A middle distillate composition as claimed in claim 5 wherein R is an alkyl group having 4–20 carbon atoms.

7. A middle distillate composition as claimed in claim 5 wherein R'' is an alkylene group having 1–8 carbon atoms.

8. A middle distillate composition as claimed in claim 5 wherein R'' is $—CH_2CH_2—$.

9. A middle distillate composition as claimed in claim 5 wherein R' is $$—CH_2\underset{\underset{CH_3}{\vert}}{C}H—$$

10. A middle distillate composition as claimed in claim 5 wherein a is 1–4.

11. A middle distillate composition as claimed in claim 5 wherein R″ is a divalent alkylene group containing 1–2 carbon atoms.

12. A middle distillate composition comprising (a) a major portion of a petroleum derived hydrocarbon fuel boiling in the jet fuel boiling range;

(b) an extending portion of a shale oil diesel fraction;

(c) a minor effective amount, 0.1–0.3 w% of the fuel, of $$CH_3(CH_2)_{8-10}CH_2(OCH_2\underset{\underset{CH_3}{|}}{C}H)_2NHCH_2CH_2COOH$$

* * * * *